US007905183B2

(12) United States Patent
Gibson et al.

(10) Patent No.: US 7,905,183 B2
(45) Date of Patent: Mar. 15, 2011

(54) STRUCTURAL CARDBOARD RUNNER, PALLET, SHIPPING ARTICLE

(76) Inventors: Daniel J. Gibson, Zeeland, MI (US); Patrick R. Patten, West Olive, MI (US)

( * ) Notice: Subject to any disclaimer, the term of this patent is extended or adjusted under 35 U.S.C. 154(b) by 159 days.

(21) Appl. No.: 12/275,930

(22) Filed: Nov. 21, 2008

(65) Prior Publication Data

US 2009/0188411 A1 Jul. 30, 2009

Related U.S. Application Data

(60) Provisional application No. 61/024,304, filed on Jan. 29, 2008.

(51) Int. Cl.
*B65D 19/00* (2006.01)

(52) U.S. Cl. ..... 108/51.3; 108/55.1; 206/386

(58) Field of Classification Search ..... 108/51.3, 108/51.11, 56.1, 56.3, 57.12; 206/386, 600, 206/599, 598, 595, 596
See application file for complete search history.

(56) References Cited

U.S. PATENT DOCUMENTS

| | | | | | |
|---|---|---|---|---|---|
| 2,444,183 | A | | 6/1948 | Cahners | |
| 2,728,545 | A | * | 12/1955 | Hermitage | 108/51.3 |
| 2,965,276 | A | | 12/1960 | Foster | |
| 3,006,590 | A | | 10/1961 | Hoag | |
| 3,434,435 | A | | 3/1969 | Achermann et al. | |
| 3,776,146 | A | | 12/1973 | Morrison | |
| 3,861,326 | A | | 1/1975 | Brown | |
| 3,911,834 | A | | 10/1975 | Quaintance | |
| 3,921,892 | A | | 11/1975 | Macie | |
| 4,102,525 | A | * | 7/1978 | Albano | 108/51.3 |
| 4,185,565 | A | | 1/1980 | Nymoen | |
| 4,244,766 | A | | 1/1981 | Yellen | |
| 4,445,614 | A | | 5/1984 | Mitsumori et al. | |
| 4,487,136 | A | | 12/1984 | Beckway | |
| 4,563,377 | A | * | 1/1986 | Melli | 108/51.3 |
| 4,574,955 | A | * | 3/1986 | Camossi | 206/583 |
| 4,671,188 | A | | 6/1987 | Betro et al. | |
| 4,850,284 | A | | 7/1989 | DeGroot et al. | |
| 4,979,446 | A | | 12/1990 | Winebarger | |
| 5,037,027 | A | * | 8/1991 | Nichols | 206/512 |
| 5,184,558 | A | * | 2/1993 | Wozniacki | 108/51.3 |
| 5,207,631 | A | * | 5/1993 | Schmidtke et al. | 108/51.3 |
| 5,218,913 | A | * | 6/1993 | Winebarger et al. | 108/51.3 |
| 5,275,279 | A | * | 1/1994 | Grigsby | 206/586 |
| 5,289,781 | A | | 3/1994 | Beckway | |
| 5,337,679 | A | | 8/1994 | Moorman | |
| 5,339,746 | A | | 8/1994 | Vannatta | |
| 5,350,066 | A | | 9/1994 | Mendoza et al. | |
| 5,357,875 | A | * | 10/1994 | Winebarger et al. | 108/51.3 |
| 5,370,061 | A | * | 12/1994 | Kilpatrick et al. | 108/51.3 |

(Continued)

*Primary Examiner* — José V Chen
(74) *Attorney, Agent, or Firm* — Price, Heneveld Cooper, DeWitt & Litton LLP

(57) ABSTRACT

A runner for pallets includes a cardboard sheet folded to include a first portion forming an M shape, a second portion folded across the M shape to form two closed triangles, and a third portion folded around the M shape including sections along and adjacent a first outer leg of the M shape and across the M shape and along and adjacent a second outer leg of the M shape. Adhesive bonds the third portion to the first and second portions. The arrangement forms a beam of sufficient structural rigidity to support the vertical and horizontal "abuse" often received by pallets. Notches for fork lift tines are cut into the length for matching a typical location of the fork lift tines. A pallet includes a deck such as cardboard or other material, and three runners attached to a bottom of the deck.

14 Claims, 6 Drawing Sheets

U.S. PATENT DOCUMENTS

| | | | | |
|---|---|---|---|---|
| 5,385,625 | A | 1/1995 | LaFreniere | |
| 5,406,892 | A | 4/1995 | Kilpatrick et al. | |
| 5,423,270 | A | 6/1995 | Kilpatrick et al. | |
| 5,427,019 | A | 6/1995 | Moorman | |
| 5,433,156 | A | 7/1995 | Hutchison | |
| 5,450,998 | A | 9/1995 | Esse et al. | |
| 5,469,795 | A | 11/1995 | Moorman | |
| RE35,131 | E | 12/1995 | Youell, Jr. et al. | |
| 5,483,875 | A | 1/1996 | Turecek et al. | |
| 5,487,345 | A | 1/1996 | Winebarger et al. | |
| 5,520,120 | A | 5/1996 | Badger | |
| 5,528,994 | A | 6/1996 | Iseli | |
| 5,535,668 | A | 7/1996 | Besaw et al. | |
| D374,324 | S | 10/1996 | Besaw | |
| 5,564,344 | A | 10/1996 | Downes, Jr. et al. | |
| 5,568,774 | A | 10/1996 | Hutchison | |
| 5,569,148 | A | 10/1996 | LaFreniere et al. | |
| 5,603,258 | A | 2/1997 | Besaw | |
| 5,609,111 | A * | 3/1997 | Hasegawa et al. | 108/55.1 |
| 5,622,306 | A * | 4/1997 | Grigsby, Sr. | 206/386 |
| 5,660,119 | A | 8/1997 | Perkins | |
| 5,669,315 | A | 9/1997 | Model | |
| 5,672,412 | A | 9/1997 | Phares et al. | |
| 5,713,289 | A | 2/1998 | Model | |
| D395,534 | S | 6/1998 | Besaw | |
| 5,794,542 | A | 8/1998 | Besaw | |
| 5,881,652 | A | 3/1999 | Besaw | |
| 5,904,103 | A | 5/1999 | Maresh et al. | |
| 5,996,510 | A | 12/1999 | Harpman et al. | |
| 6,029,582 | A | 2/2000 | Ogilvie, Jr. et al. | |
| 6,041,718 | A | 3/2000 | Brandes et al. | |
| 6,135,030 | A | 10/2000 | Besaw | |
| 6,173,658 | B1 | 1/2001 | Moberg | |
| 6,354,229 | B1 | 2/2002 | Heidtke | |
| 6,539,880 | B2 * | 4/2003 | Simms | 108/51.3 |
| 6,564,724 | B2 | 5/2003 | Moberg | |
| 6,948,434 | B2 | 9/2005 | Horiuchi | |
| 7,000,549 | B2 | 2/2006 | Nelson | |
| 7,007,613 | B2 | 3/2006 | Sketo | |
| 7,475,639 | B2 * | 1/2009 | Chen | 108/51.3 |
| 7,654,390 | B2 * | 2/2010 | Baechle et al. | 206/386 |
| 7,673,569 | B2 * | 3/2010 | Ishikawa et al. | 108/55.1 |
| 2006/0102517 | A1 * | 5/2006 | Chen | 206/386 |
| 2006/0108408 | A1 * | 5/2006 | Lowry | 206/386 |
| 2007/0068426 | A1 | 3/2007 | Teags et al. | |

* cited by examiner

STRUCTURAL CARDBOARD RUNNER, PALLET, SHIPPING ARTICLE

This application claim benefit under 35 U.S.C. §119(e) of provisional application Ser. No. 61/024,304, filed Jan. 29, 2008, entitled PALLET WITH CARDBOARD RUNNER, the entire contents of which are incorporated herein in their entirety.

BACKGROUND

The present invention relates to structural cardboard runners, and pallets and shipping articles for material handling. The present invention relates especially to a pallet including cardboard runners, but is not limited to only runners, nor only pallets.

Traditional wood pallets are expensive to purchase and maintain. Further, they are not always easily disposed of. In particular, disposal of wood pallets can be problematic in large cities where downtown is congested, because trucks cannot wait at drop off sites. Instead, the trucks must make a return trip (i.e., an "empty run") to the drop off site through traffic and congestion to pick up empty pallets, wasting considerable time and adding substantially to shipping expense.

Cardboard has been used to make pallets and runners of pallets. However, known pallets that incorporate cardboard often lack durability and strength. Further, cardboard runners are problematic because runners experience "horizontal abuse" from fork truck tines as they engage and disengage a pallet to move and/or position the pallets on storage racks, and further experience "vertical abuse" as heavy packages put downward pressure on the runner against uneven ground support and/or storage racks and/or wet surfaces.

SUMMARY OF THE PRESENT INVENTION

In one aspect of the present invention, a structural beam is provided for use in pallets, where the beam includes a cardboard sheet having a length adapted to match a pallet dimension, the sheet being folded in a width direction to include a cross section with a first portion forming an M shape, a second portion folded across the M shape to form two closed triangles, and a third portion folded around the M shape including sections along and adjacent a first outer leg of the M shape and across the M shape and along and adjacent a second outer leg of the M shape. Adhesive bonds the third portion to the first and second portions. The arrangement forms a beam of sufficient structural rigidity to support the vertical and horizontal "abuse" often received by runners of pallets.

In a narrower aspect of the present invention, notches sufficient for fork lift tines are cut into the length of the folded sheet at locations spaced from each other and spaced from ends of the length for matching a typical location of the fork lift tines.

In a narrower aspect of the present invention, a pallet is made comprising a deck and at least three of the structural beams defined above attached to a bottom of the deck as runners. The deck can be cardboard or other material.

In another aspect of the present invention, a pallet includes a plurality of parallel tubular structural runners made of stiff sheeting, a plurality of structural cross beams made of similar stiff sheeting and positioned orthogonally on the runners, and a deck attached atop the runners and cross beams. The runners and cross beams each include a cross section with internal walls forming an M shape and further with a perimeter wall enclosing the internal walls to form a tubular shape. The runners and cross beams each have mating first notches spaced from but near ends thereof and at least one mating notch at an intermediate location with a size and depth of the first notches and mating notch being such that the runners and cross beams fit snugly matably together at each cross location to form orthogonally-strong structural connections. At least the runners further have second notches for receiving tines of a fork truck.

The present invention further includes an article for shipping a product, the article including a plurality of tubular elongated structural beams made of stiff sheeting, the structural beams each including a cross section with internal walls forming an M shape and further with a perimeter wall enclosing the internal walls to form a tubular shape; extending orthogonally to each other to define twelve edges of a box shape. A plurality of corner pieces at each corner of the box shape for supporting a product therein for shipment.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
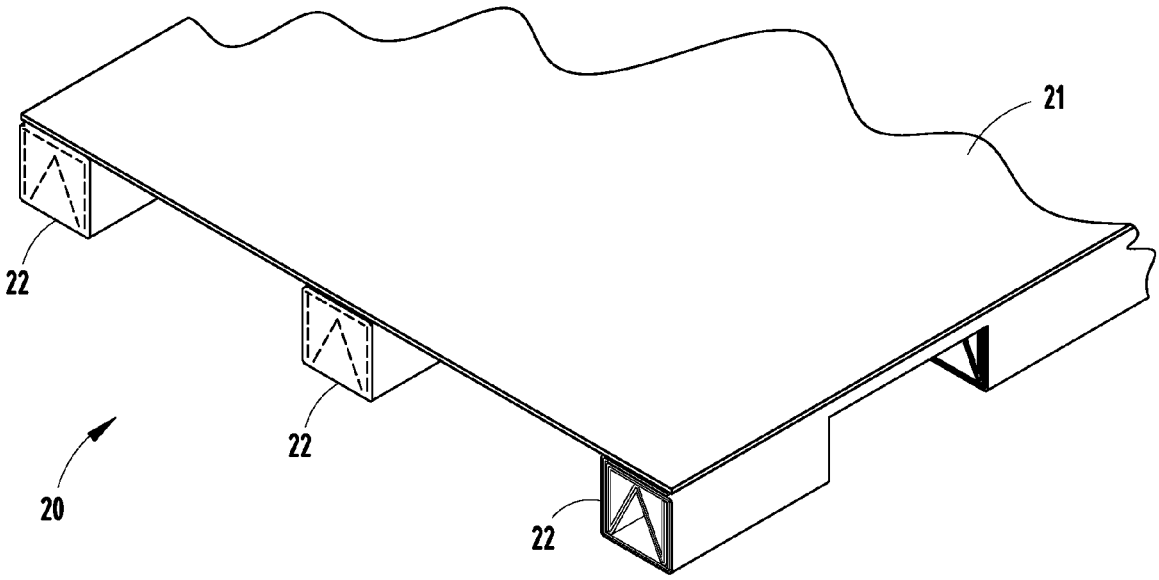
FIG. 1 is a fragmentary perspective view of a pallet including cardboard runners.
Figure 2:
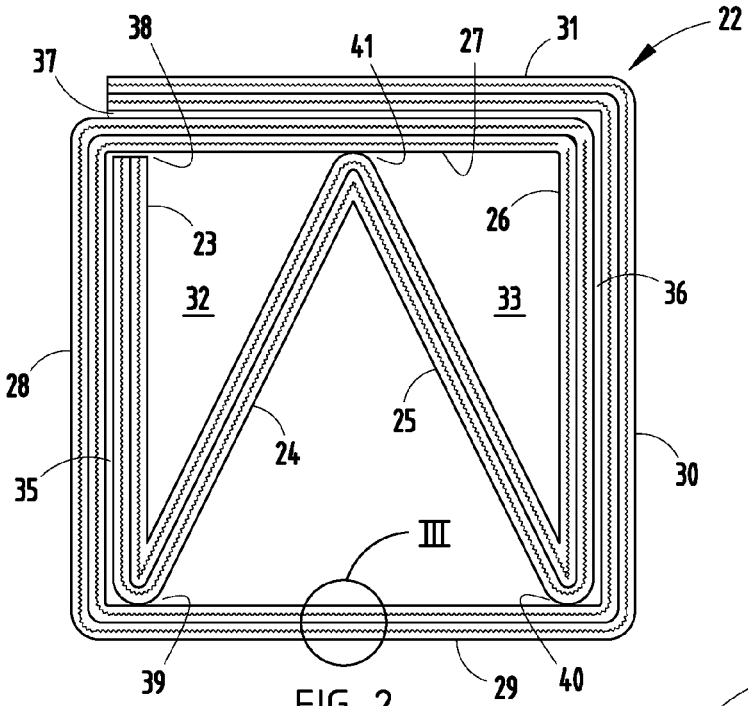
FIG. 2 is an end view of the runner in FIG. 1.
Figure 3:
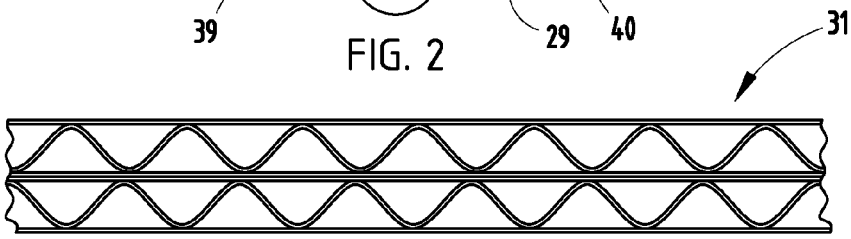
FIG. 3 is a cross-sectional view of a cardboard sheet.

A pallet 20 (FIG. 1) includes a deck 21 and three runners 22 (also called "structural beams" herein) adhered to its bottom surface. Each runner 22 is a cardboard sheet having a length adapted to match a pallet dimension. The term "cardboard" as used herein is intended to include paper, plastic, and other stiff sheet material equivalent to the strength and structure of paper and cardboard. The sheet is folded in a width direction to include a first portion (sections 23-26) forming an M shape, a second portion (section 27) folded across the M shape to form two closed triangles 32 and 33, and a third portion (sections 28-31) folded around the M shape. The section 28 extends along and adjacent a first outer leg (section 23) of the M shape. Section 29 extends across the M shape and section 30 extends along and adjacent a second outer leg (section 26) of the M shape. Adhesive bonds the third portion to the first and second portions at locations 35-37, which include large flat adjacent areas well suited for high bonding strength. Adhesive can also be located at locations 38-41 if desired and if additional stability of the M shape is desired. Notches 49 are cut into the runners 21 at locations spaced from each other and from ends of the runners 21. The notches 49 have a width for receiving a fork truck tine, and further have a depth of about 70%-90% of a depth of the runner 22, such that the unsupported vertical wall of cardboard is minimized in order to minimize damage to the runners 22 from the fork truck tines sliding in and out and when lifting the pallet 20.

The present runner forms a structural beam that is surprisingly and unexpectedly strong and durable, and that is well suited for use as a runner to provide sufficient structural rigidity to withstand the stress and the vertical and horizontal "abuse" often received by pallets. For example, my testing showed that the illustrated runner can hold up to 5,000 pounds using 42 DW Cor corrugated cardboard. I believe this strength and stability comes in large part from the V-shaped internal support that stabilizes the outer "box" of the runner in diagonal directions from opposing corners to a center-point of a wall opposite the corners, thus providing optimal structure to prevent a parallelogram-type collapse. This V-shape has been found to be stronger than other configurations that I have tested, including X, W, Z and single-angled-wall shapes. Also, the double walls on the opposing sides and top of the runner provide strength in a manner well suited for cardboard sections held together by adhesive bonding since they provide large flat surface areas. The double walls also provide protection for the internal structural diagonally-strong V shape. It contemplated that an additional section of cardboard can be extended across the bottom of the runner to form a double wall completely around the M shaped portion of the runner if desired, such as if additional material is desired at a bottom of the runner where supporting surfaces rub (i.e. racks and/or floor surfaces). Also, it is contemplated that the present runner can be used with the "M" shaped portion being either inverted (see FIG. 1) or upright (i.e., upside down from FIG. 1) when in a pallet.

Different cardboards and sheets can be used for the present runner. As noted above, 42 DW Cor corrugated cardboard works well based on testing for typically sized runners and pallet loads. However, other corrugated cardboards can be used, such as 32 C, 44 C, 42 DW*, and 42 DW.

The illustrated deck is also made of cardboard material. It is contemplated that the same cardboard can be used for the runner, or it can be a different grade of cardboard or paper sheet material. Further, a sheet other than cardboard can be used if desired, such as wood, plastic, or composite, and also the sheet can be treated to include properties desired for particular applications. Notably, the present runner 22 presents a large flat top surface and large bonding area for receiving adhesive. This adds considerably to a strength of the overall pallet, due to the large bonding area. Also, where corrugated cardboard is used for both the runner and the deck, with the bonded corrugated sheets extending in parallel juxtaposed positions where they support each other and also help distribute stress.

Modification

Figure 4:
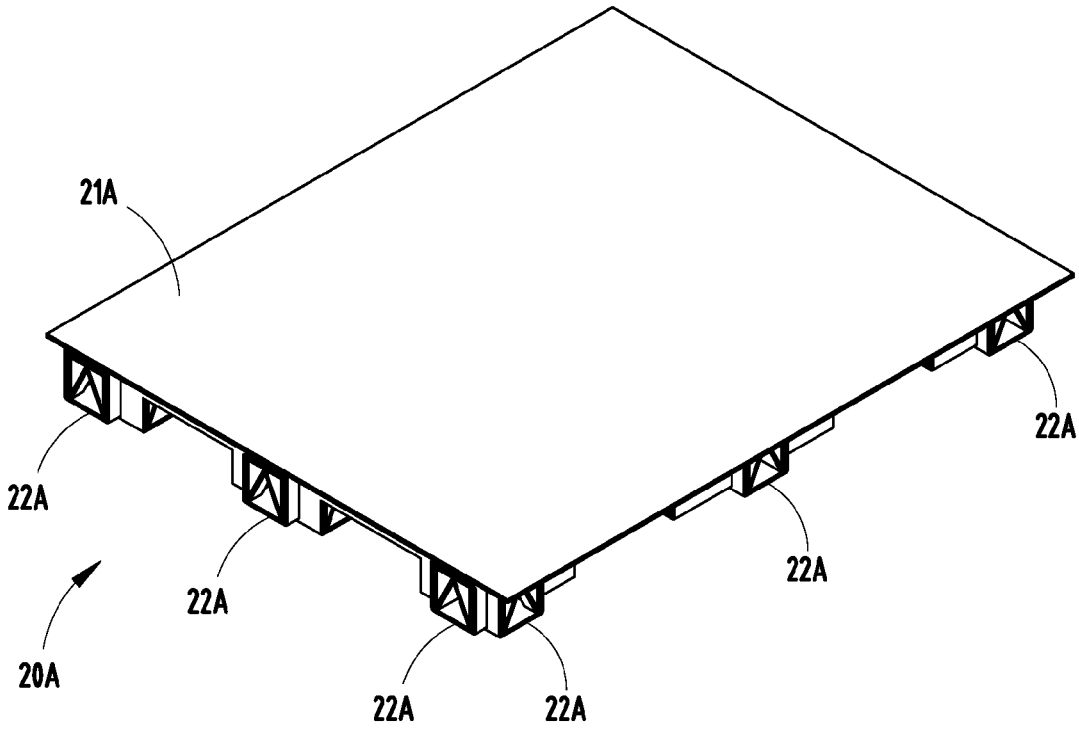
FIGS. 4-4B are perspective views of a pallet with cardboard runners and cardboard deck, FIG. 4 being the assembled product, FIG. 4A being identical to FIG. 4 but with the deck removed to better show the criss-crossed runners, and FIG. 4B being exploded apart.
Figure 4A:
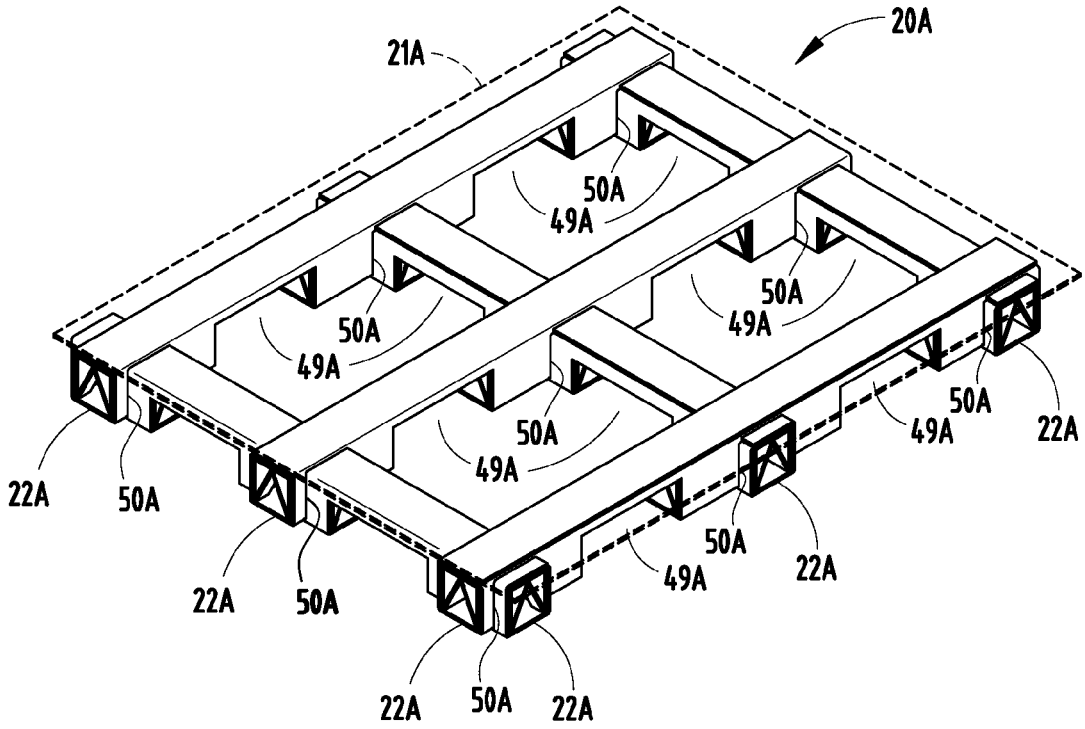
Figure 4B:
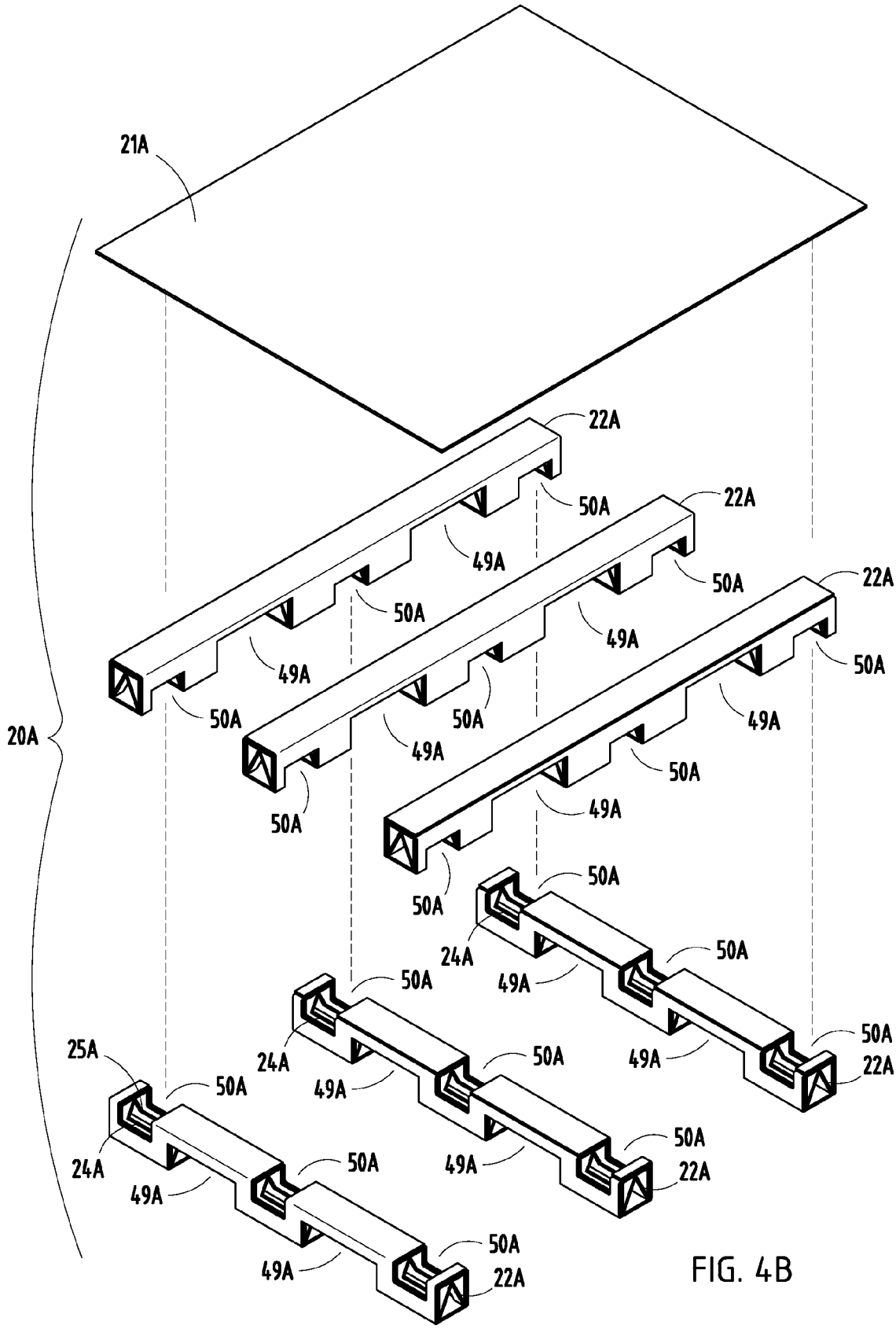
Figure 5:
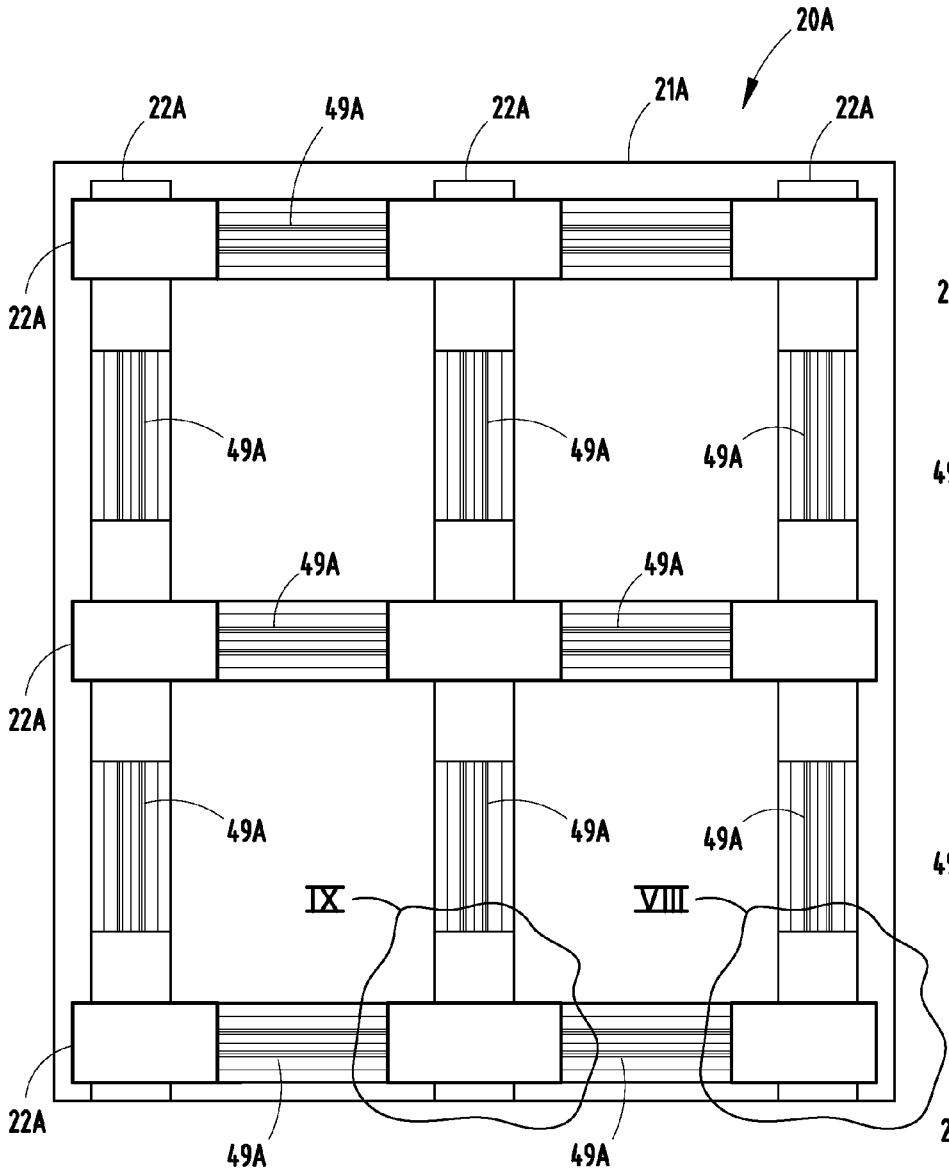
FIGS. 5-7 are orthogonal views of the pallet shown in FIG. 4, FIG. 5 being a bottom view and FIGS. 6-7 being side views.
Figure 7:
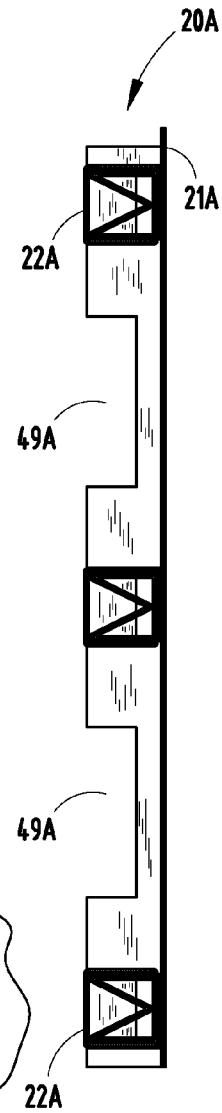
Figure 6:
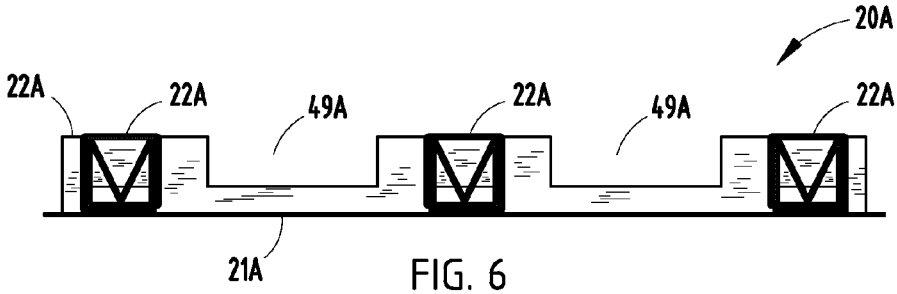
Figure 8:
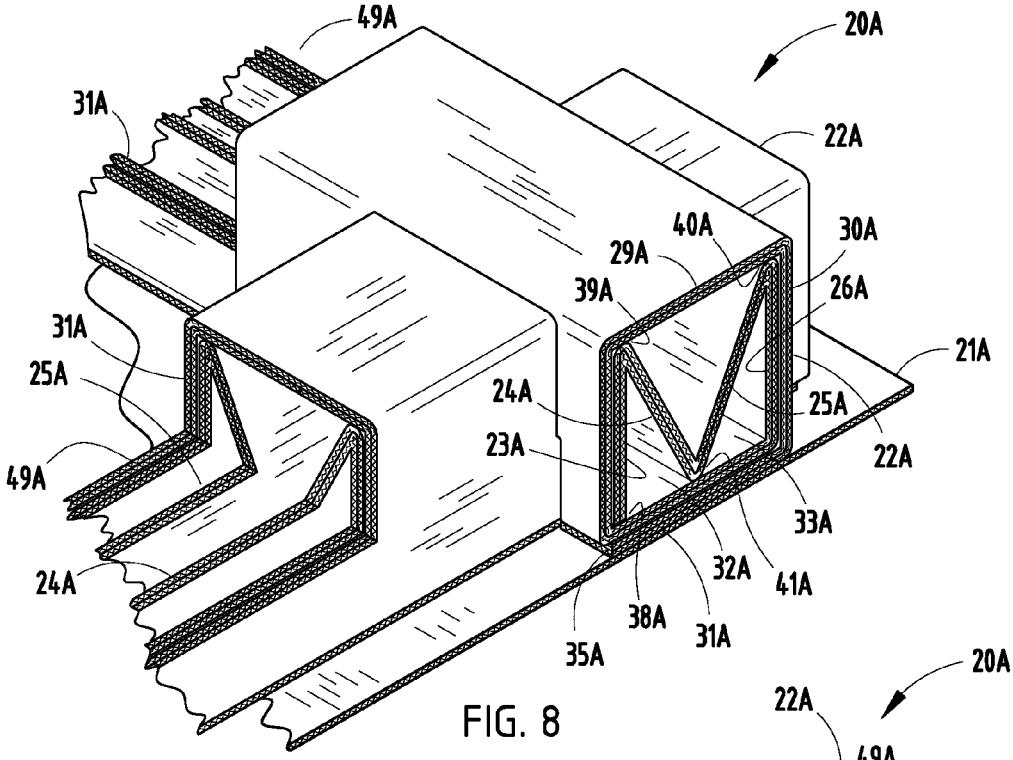
FIGS. 8-9 are enlarged perspective views of an end connection and a middle connection, respectively, of criss-crossed runners as shown in FIG. 4A.
Figure 9:
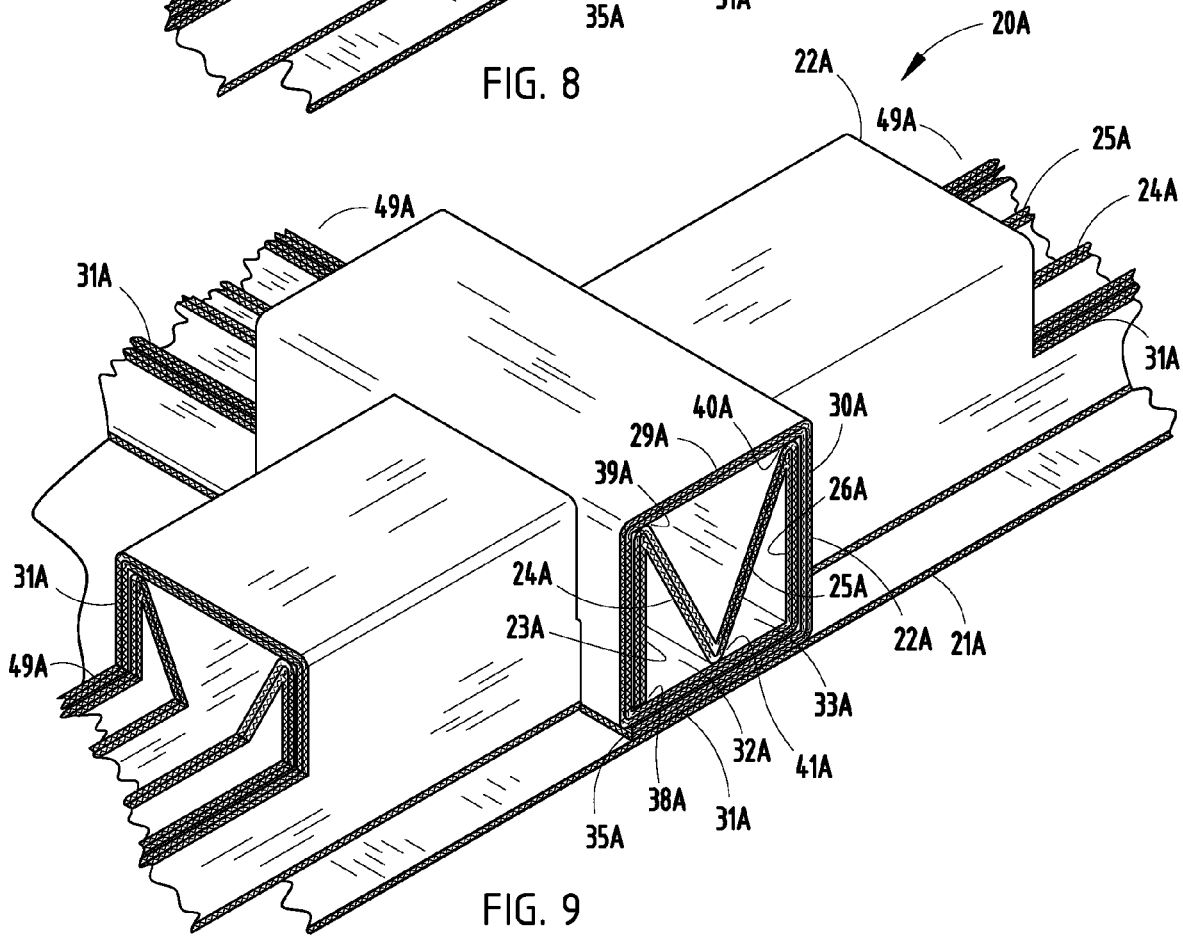

A modified pallet 20A (FIGS. 4-9) is similar to pallet 20, and similar components and features are similarly identified but with the addition of the letter "A". Modified pallet 20A includes parallel runners 22A (three shown) (FIGS. 4-4B) that are notched and criss-crossed with additional runners 22A (three shown) (also called "cross beams") to form an interconnected orthogonal matrix, with all parallel runners 22A and additional runners 22A lying in a common plane. The runners 22A are similar to runners 22 in that they include similar portions 23-26 forming an M shape, and additional outer portions 27-31 to enclose the M shape. When combined with a top deck 21A, the pallet 20A formed is orthogonally rigid and surprisingly strong. The notches 50A (FIG. 4B) in the runners 22A extend to half a depth of the runners 22A and have a length that exactly matches a width of the criss-crossed runners 22A.

By this arrangement, the marginal material around the notches 50A is supported by the criss-crossed runners 22A, such that they form orthogonally rigid joints when connected. Further, the notches 50A into the internal M shape cut the angled walls formed by portions 24A-25A to a half-height. These half-height angled walls engage mating parts of the criss-crossed runner 22A, thus further strengthening the joint. The criss-crossed connection of runners 22A is quick, relatively easy, and very effective in strength and function, especially when bonded with a glue or adhesive. Further, adhering the top deck 21A to the orthogonal matrix of runners 22A further rigidifies the pallet 20A. It is noted that the illustrated deck 21A is flush with an end of the runners in one direction, but extends about an inch off the end of the perpendicular runners. It is contemplated that the deck can be modified as desired for particular applications, such as by having slits or holes as desired to anchor product thereon. It is also contemplated that an outer edge can be doubled back onto the deck if desired to create a physical lip around a part or all of the pallet's perimeter. It is contemplated that the notches 49A for receiving fork truck tines can be on all runners 22A if desired, thus permitting a fork truck to engage its tines from any of the four sides of the pallet 20A.

Figures 10, 11:
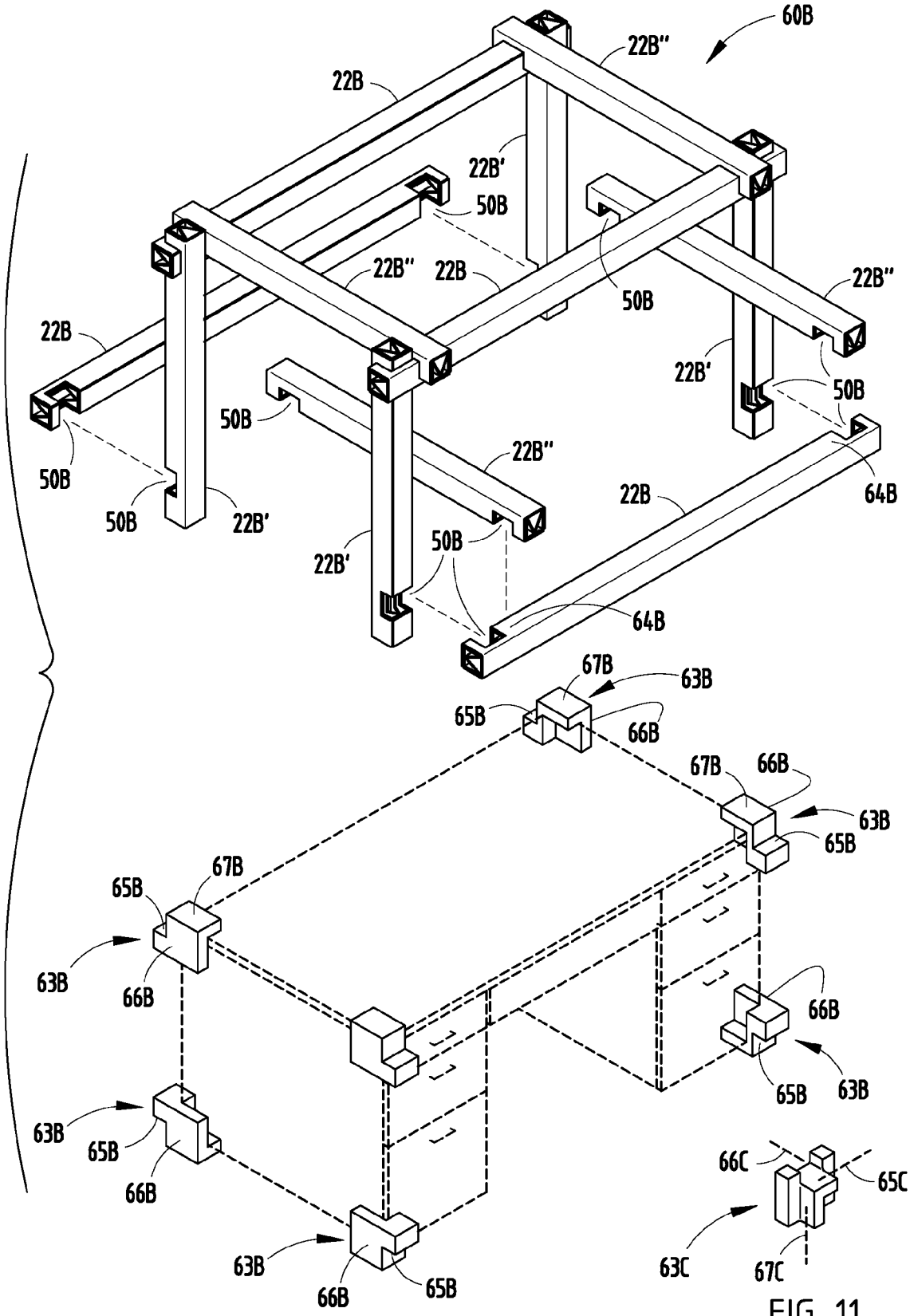
FIG. 10 is a perspective view of a packaging article for material handling, the packaging article including a space frame of criss-crossed cardboard runners and including foam corner supports for a piece of furniture.
FIG. 11 is a perspective view of an alternative foam corner.

Structural beams 22B, 22B', 22B" (FIG. 10) are identical in cross section to the beams 22 and 22A, but beams 22B are used to form a space frame article 60B useful for material handling purposes, such as for shipping large product (see desk shown in FIG. 10) and/or for storing large product in a protected environment. The illustrated article 60B includes four long beams 22B, four vertical end beams 22B', and four horizontal end beams 22B", the beams 22B, 22B', 22B" each extending generally parallel one of the twelve edges of the desk product shown in FIG. 10 when assembled onto the product. The long beams 22B and vertical end beams 22B' include notches 50B so that they can be mated together to form orthogonally-rigid connections, allowing them to form a rectangular front frame and a rectangular rear frame. The foam corner pieces 63B are then placed on and engage corners of the product being shipped, and the rectangular front and rear frames are pressed against the product 61B and foam corner pieces 63B to hold them in place. The horizontal end beams 22B" include a notch 50B, but the notches 50B on the end beams 22B" are fit onto an uncut region 64B of the long beams 20B in a manner holding the front and rear frames together on the product. It is noted that additional beams 22B, 22B', and/or 22B" can be used at intermediate locations to further stiffen and support the beams used at corners of the product.

Notably, a variety of different pieces can be used in place of the illustrated foam corner pieces 63B, and also that the corner pieces can be a variety of different shapes depending on their functional requirements. For example, the foam corner pieces 63B define a channel 65B for receiving the long beams 22B, but the vertical end beams 22B' engage an outer surface 66B of the corner pieces 63B, and the horizontal end beams 22B" engage a top (or bottom) surface 67B of the corner pieces 63B. Contrastingly, the modified foam piece 63C includes channels 65C, 66C, and 66C for receiving each of the beams 22B, 22B', and 22B", respectively. It is contemplated that the corner pieces can include more or less channels, and be made of different materials (such as cardboard or other plastic rather than foam), and also can be simply a sheet to separate the product from the cardboard runner (where the product has an aesthetic surface that can be scratched).

It is to be understood that variations and modifications can be made on the aforementioned structure without departing from the concepts of the present invention, and further it is to be understood that such concepts are intended to be covered by the following claims unless these claims by their language expressly state otherwise.

The embodiments of the invention in which an exclusive property or privilege is claimed are defined as follows:

1. A structural beam adapted for use as a runner in a pallet, comprising:

a cardboard sheet having edges and a length adapted to match a pallet dimension, the sheet being folded to include a cross section with, in series, an edge-including first portion forming an M shape, a second portion folded across the M shape to form two closed triangles, and an edge-including third portion folded around the M shape including sections along and adjacent a first outer leg of the M shape and across the M shape and along and adjacent a second outer leg of the M shape; and adhesive bonding the third portion to the first and second portions.

2. The beam defined in claim 1, wherein notches for fork lift tines are cut into the length of the folded sheet at locations spaced from each other and spaced from ends of the length for matching a typical location of the fork lift tines.

3. A pallet comprising a deck and at least three of the beams defined in claim 2, its beams being attached to a bottom of the deck for use as runners.

4. The pallet defined in claim 3, wherein the deck includes cardboard sheet adhered to the at least three beams, and wherein the at least three beams extend parallel to each other and further two of the beams are at edge locations on the deck.

5. The pallet defined in claim 3, including cross beams attached to the bottom of the deck and extending perpendicular to the structural beams to thus define cross locations, the cross beams having a same cross section as the structural beam, and both the structural beams and the cross beams including notches that interfit at the cross locations to facilitate rapid interconnection and also orthogonally-rigid connections.

6. A pallet comprising:

a plurality of parallel tubular structural runners made of stiff sheeting;

a plurality of structural cross beams made of similar stiff sheeting and positioned orthogonally on the runners; and a deck attached atop the runners and cross beams;

the runners and cross beams each including a cross section formed from a single sheet with a continuous first section of the sheet folded to form internal walls defining an M shape and further with a remaining second section of the sheet folded to form a perimeter wall enclosing the internal walls and forming a tubular shape; the runners and cross beams each having mating first notches spaced from but near ends thereof and at least one mating notch at an intermediate location with a size and depth of the first notches and mating notch being such that the runners and cross beams fit snugly matably together at each cross location to form orthogonally-strong structural connections, and at least the runners further having second notches for receiving tines of a fork truck.

7. The pallet defined in claim 6, wherein each of the mating notches in the runners have a width equal to the associated cross beams, and each of the notches in the cross beams have a width equal to a width of the associated runners.

8. The pallet defined in claim 7, wherein each of the notches in the runners have a depth equal to half a depth of the associated cross beams, and each of the notches in the cross beams have a depth equal to half a depth of the associated runners.

9. The pallet defined in claim 8, wherein the runners and cross beams all have a same cross sectional width and a same cross sectional depth.

10. The pallet defined in claim 6, wherein the runners are made from corrugated cardboard.

11. The pallet defined in claim 6, wherein the cross beams are made from corrugated cardboard.

12. The pallet defined in claim 6, wherein the deck is made from corrugated cardboard.

13. An article for shipping a product, comprising:

a plurality of tubular elongated structural beams made of stiff cardboard sheeting, the structural beams each including a cross section with internal walls forming an M shape and further with a perimeter wall enclosing the internal walls to form a tubular shape; the beams engaging each other and extending orthogonally to each other to define a space frame with each beam extending generally parallel one of twelve edges of a box shaped product; and polymeric corner pieces at each corner of the box shape, the corner pieces each including an inner surface for engaging and supporting the product therein for shipment, each of the corner pieces further including at least one channel for receiving and engaging at least one of the beams for holding the product safely within the space frame during shipment.

14. The article defined in claim 13, wherein the structural beams overlap at each corner and include mating notches spaced inward from respective ends to form structural overlapping connections at each corner.

* * * * *